US011213125B2

(12) United States Patent
Irgang et al.

(10) Patent No.: US 11,213,125 B2
(45) Date of Patent: Jan. 4, 2022

(54) DRAWER SIDE WALL HAVING A COVER PROFILE

(71) Applicant: Julius Blum GmbH, Hoechst (AT)

(72) Inventors: Markus Irgang, Altach (AT); Guenter Schwarzmann, Dornbirn (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 16/904,871

(22) Filed: Jun. 18, 2020

(65) Prior Publication Data

US 2020/0315348 A1 Oct. 8, 2020

Related U.S. Application Data

(63) Continuation of application No. PCT/AT2018/060296, filed on Dec. 13, 2018.

(30) Foreign Application Priority Data

Dec. 21, 2017 (AT) ..... A 51065/2017

(51) Int. Cl.
*A47B 88/95* (2017.01)
*A47B 88/90* (2017.01)
(Continued)

(52) U.S. Cl.
CPC ..... *A47B 88/95* (2017.01); *A47B 88/925* (2017.01); *A47B 88/941* (2017.01);
(Continued)

(58) Field of Classification Search
CPC ..... A47B 88/90; A47B 88/925; A47B 88/941; A47B 88/944; A47B 88/95; A47B 88/956;
(Continued)

(56) References Cited

U.S. PATENT DOCUMENTS 6,053,593 A 4/2000 Röck
6,412,893 B1 * 7/2002 Muterthies ..... A47B 88/941 312/330.1
(Continued)

FOREIGN PATENT DOCUMENTS

CN 102448346 5/2012
CN 102058255 12/2012
(Continued)

OTHER PUBLICATIONS

International Search Report dated Feb. 28, 2019 in International (PCT) Application No. PCT/AT2018/060296.

*Primary Examiner* — Andrew M Roersma
(74) *Attorney, Agent, or Firm* — Wenderoth, Lind & Ponack, L.L.P.

(57) ABSTRACT

A drawer side wall includes a fastening device forming a self-contained functional unit, such that a furniture fitting can be removably fastened by the fastening device independently of a multi-function component. At least two properties selected from the following group are implemented: (i) the multi-function component has at least two support contours on which the cover profile is supported, (ii) the multi-function component has a joining device pointing in a direction of the front panel, (iii) the cover profile has an opening to be covered by a cover part, (iv) the fastening device has an adjustment device for adjusting the position of the front panel relative to the drawer side wall and/or a device for locking and/or releasing the front panel, (v) the fastening device has a component movable relative to the drawer side wall, and (vi) the cover profile has an interface for connecting an attachment element.

12 Claims, 9 Drawing Sheets

(51) Int. Cl.
*A47B 88/956* (2017.01)
*A47B 88/925* (2017.01)
*A47B 88/944* (2017.01)

(52) U.S. Cl.
CPC ..... *A47B 88/944* (2017.01); *A47B 88/956* (2017.01); *A47B 2210/02* (2013.01)

(58) Field of Classification Search
CPC ..... A47B 88/0014; A47B 88/0044; A47B 88/0051; A47B 88/0055; A47B 2088/0059; A47B 2088/0062; A47B 2088/0066; A47B 2088/007; A47B 2088/0074; A47B 2088/0007; A47B 2088/951; A47B 2088/952; A47B 2088/953; A47B 2088/954; A47B 2088/955; A47B 2210/01; A47B 2210/02; A47B 2210/09
See application file for complete search history.

(56) References Cited

U.S. PATENT DOCUMENTS

| | | | | |
|---|---|---|---|---|
| 8,727,461 | B2 | 5/2014 | Holzapfel et al. | |
| 8,801,123 | B2 | 8/2014 | Kueng | |
| 9,033,436 | B2 * | 5/2015 | Holzapfel | A47B 88/956 312/348.4 |
| 9,386,848 | B2 | 7/2016 | Holzapfel | |
| 10,010,174 | B2 | 7/2018 | Chen et al. | |
| 10,188,209 | B2 * | 1/2019 | Hoffmann | A47B 88/95 |
| 2013/0249370 | A1 | 9/2013 | Kueng | |
| 2013/0257252 | A1 | 10/2013 | Holzapfel et al. | |
| 2014/0252936 | A1 | 9/2014 | Holzapfel | |
| 2014/0312756 | A1 | 10/2014 | Ng | |
| 2017/0135473 | A1 | 5/2017 | Chen et al. | |
| 2018/0000242 | A1 * | 1/2018 | Hoffmann | A47B 88/95 |
| 2019/0191878 | A1 * | 6/2019 | Rocklage | A47B 88/956 |

FOREIGN PATENT DOCUMENTS

| | | | | |
|---|---|---|---|---|
| CN | 104398027 | | 3/2015 | |
| CN | 206102106 | | 4/2017 | |
| DE | 202012102980 | U1 * | 9/2012 | A47B 88/956 |
| DE | 20 2014 101 848 | | 7/2014 | |
| DE | 10 2015 102 771 | | 9/2016 | |
| EP | 2 374 370 | | 10/2011 | |
| EP | 3 167 760 | | 5/2017 | |
| JP | 2014-500074 | | 1/2014 | |
| WO | 2010/136228 | | 12/2010 | |
| WO | 2012/055158 | | 5/2012 | |
| WO | 2012/068599 | | 5/2012 | |
| WO | 2013/075152 | | 5/2013 | |
| WO | 2014/005164 | | 1/2014 | |
| WO | 2016/145465 | | 9/2016 | |
| WO | WO-2016145465 | A1 * | 9/2016 | A47B 88/956 |
| WO | WO-2018171356 | A1 * | 9/2018 | A47B 88/956 |

* cited by examiner

DRAWER SIDE WALL HAVING A COVER PROFILE

BACKGROUND OF THE INVENTION

The invention concerns a drawer side wall having a cover profile and a fixing device for releasably fixing a front panel to the drawer side wall, and the fixing device is at least predominantly arranged in the interior of the cover profile. The invention further concerns a drawer comprising at least one such drawer side wall.

Drawer side walls having a cover profile and an integrated fixing device are already known from the state of the art. However, they suffer from a number of disadvantages.

In general, the fixing device is spaced from the inner walls of the cover profile. That means that the cover profile has a play at least in the front region relative to the fixing device. That results in instability of the drawer side wall. In addition, insertion of a furniture fitment to be mounted to the front panel into the fixing device is found to be difficult for a user as the furniture fitment has to be introduced at a given location of the fixing device, but that only succeeds on the second or third attempt precisely when dealing with heavy front panels.

In addition, the fixing device generally includes a plurality of screws or the like which have to be actuated by a user and which have to be accessible from the exterior. In many cases that results in an aesthetically unattractive appearance. In addition a user is frequently not certain how he has to actuate the fixing screws. And finally the fixing device generally includes movable components, in respect of which there is the risk of the user suffering finger injuries.

A further disadvantage is also that the drawer side wall is to be enlarged upwardly by attachment elements. Such attachment elements, for example in the form of glass or metal walls, have to be joined in some way to the drawer side wall. That also results in an aesthetically unattractive appearance.

SUMMARY OF THE INVENTION

The object of the present invention is to avoid at least some of those disadvantages in the state of the art and to provide a drawer side wall which is improved in relation thereto or a drawer including at least one such improved drawer side wall, which are distinguished in particular by high stability, enhanced operating comfort for a user and/or an attractive appearance.

In the drawer side wall according to the invention, the cover profile has an inner wall and the drawer side wall has a multi-function component which is separate from the cover profile and the fixing device and which is at least region-wise arranged between the inner wall of the cover profile and the fixing device. The fixing device forms a self-contained functional unit so that a furniture fitment to be mounted to the front panel can be releasably fixed independently of the multi-function component by means of the fixing device. Moreover, at least two properties selected from the following group are implemented:

- the multi-function component has at least two support contours which are spaced from each other transversely relative to a longitudinal extent of the drawer side wall and at which the cover profile is supported,
- the multi-function component has a joining device facing in the direction of the front panel to be fixed to facilitate insertion of the furniture fitment to be mounted to the front panel into the fixing device,

- the cover profile has an opening which can be covered by a cover portion, wherein the multi-function component includes a support structure at which the cover portion can be supported when covering the opening,
- the fixing device has at least one adjustment device for adjusting the position of the front panel with respect to the drawer side wall and/or a device for locking and/or releasing the front panel to or from the fixing device, wherein the multi-function component includes operating instructions consisting of lines for facilitating operation of the at least one adjustment device or device for locking and/or releasing the front panel by a user,
- the fixing device has at least one component movable relative to the drawer side wall, wherein the multi-function component includes a cover means for at least region-wise shielding of the movable component upon a movement relative to the drawer side wall, and
- the cover profile has at least one interface for connecting an attachment element, wherein the interface includes an opening in the cover profile and the multi-function component includes a movably mounted cover portion which closes the opening in a first position and exposes the opening in a second position.

An essential feature of the invention therefore is a multi-function component which is separate from the cover profile and the fixing device and which is arranged at least region-wise between the inner wall of the cover profile and the fixing device, preferably wherein the multi-function component at least region-wise encloses the fixing device. By means of that multi-function component, it is possible to implement at least two functions which improve stability, operating comfort and/or the appearance of the drawer side wall. According to the invention, a group comprising a total of six such functions is provided, and at least two of those functions or properties have to be fulfilled. More advantageously, all functions or properties are implemented.

According to a preferred embodiment of the invention, at least the property is implemented that the cover profile has an opening which can be covered by a cover portion, and the multi-function component includes a support structure at which the cover portion can be supported when covering the opening, and the cover profile has at least one interface for connecting an attachment element. The interface includes an opening in the cover profile, and the multi-function component includes a movably mounted cover portion which closes the opening in a first position and exposes the opening in a second position.

The property that the multi-function component has at least support contours which are spaced from each other transversely relative to a longitudinal direction of the drawer side wall and at which the cover profile is supported makes it possible to achieve stabilization of the cover profile in particular in the front region of the drawer side wall, that is towards the front panel.

In this connection, it should be mentioned that an advantageous development is a spring element at which one of the two support contours is arranged and which acts with a force on that support contour in the direction of an inner wall of the cover profile. That spring element ensures, on the one hand, that the cover profile can be mounted without damage to the multi-function component and on the other hand, the support contour arranged on the spring element always bears in the mounted state against an inner wall of the cover profile.

By virtue of the property that the multi-function component has a joining device facing in the direction of the front panel to be fixed for facilitating insertion into the fixing device of a furniture fitment to be mounted to the front panel, it is possible to guide the user when inserting the furniture fitment to the correct position at which the furniture fitment has to be inserted into the fixing device without involving hooking or tilting of the furniture fitment on the fixing device or the cover profile.

Insertion in that way can be further facilitated by the joining device including at least one deflection contour arranged inclinedly relative to a longitudinal extent of the drawer side wall.

By virtue of the property that the cover profile has an opening which can be covered by a cover portion, wherein the multi-function component includes a support structure at which the cover portion can be supported when covering the opening it is possible to provide thin and thus visually attractive cover portions as the cover portion can be supported directly at the support structure of the multi-function component and there is no need for a separate fixing device for the cover portion.

In this connection, it has proven to be advantageous that the multi-function component has at least one spring element, by way of which the multi-function component is supported at a stationary part of the drawer side wall and can be acted upon with a force in the direction of the opening of the cover profile. In that way, the multi-function component is urged in the direction of the opening of the cover profile, with the aim of minimizing the play between the support structure of the multi-function component and the wall portion of the cover profile, in which the opening is disposed, so that the cover portion is securely supported without slipping in relation to the cover profile.

By virtue of the property that the fixing device has at least one adjustment device for adjusting the position of the front panel with respect to the drawer side wall and/or a device for locking and/or releasing the front panel to or from the fixing device, wherein the multi-function component includes operating instructions consisting of lines for facilitating operation of the at least one adjustment device or device for locking and/or releasing the front panel by a user, it is possible to give the user assistance in terms of operating the adjustment device or the device for locking and/or releasing the front panel to or from the fixing device. That enhances the user operating comfort.

In this connection, it has proven to be advantageous that the lines are in the form of recesses or raised portions in relation to the surrounding material and/or are engraved or embossed into the multi-function component.

By virtue of the property that the fixing device has at least one component movable relative to the drawer side wall and the multi-function component includes a cover means for at least region-wise shielding of the movable component upon a movement relative to the drawer side wall it is possible to reduce the risk of injury, for example to fingers, for the user. That affords an increased level of operating comfort.

It is therefore appropriate for the cover means to have at least one actuating opening of a maximum width of 10 mm, preferably 8 mm, for actuation of the movable component. That ensures that even fingers of a small diameter, for example of children, cannot be injured by a relative movement of the movable component relative to the drawer side wall.

By virtue of the property that the cover profile has at least one interface for joining an attachment element, the interface includes an opening in the cover profile and the multi-function component includes a movably mounted cover portion which closes the opening in a first position and exposes the opening in a second position it is possible to always provide for an attractive appearance for the drawer side wall, irrespective of whether an attachment element is or is not fitted on to the drawer side wall.

That effect can be enhanced by the provision of a spring element, by which the cover portion is prestressed in an operative position of the spring element in the direction of the first position. In that way the opening is automatically covered in the situation where there is no attachment element.

For fixing the multi-function component, a preferred embodiment provides that the multi-function component is connected to the fixing device, preferably by way of at least one snap-engagement and/or latching connection.

Further advantageous embodiments of the invention provide that the drawer side wall has a carrier profile, at which the cover profile, the fixing device and/or the multi-function component are arranged and/or the multi-function component substantially comprises plastic.

BRIEF DESCRIPTION OF THE DRAWINGS

Further details and advantages of the invention will be described more fully hereinafter by means of the specific description with reference to the drawings in which.

DETAILED DESCRIPTION OF THE INVENTION

Figure 1:
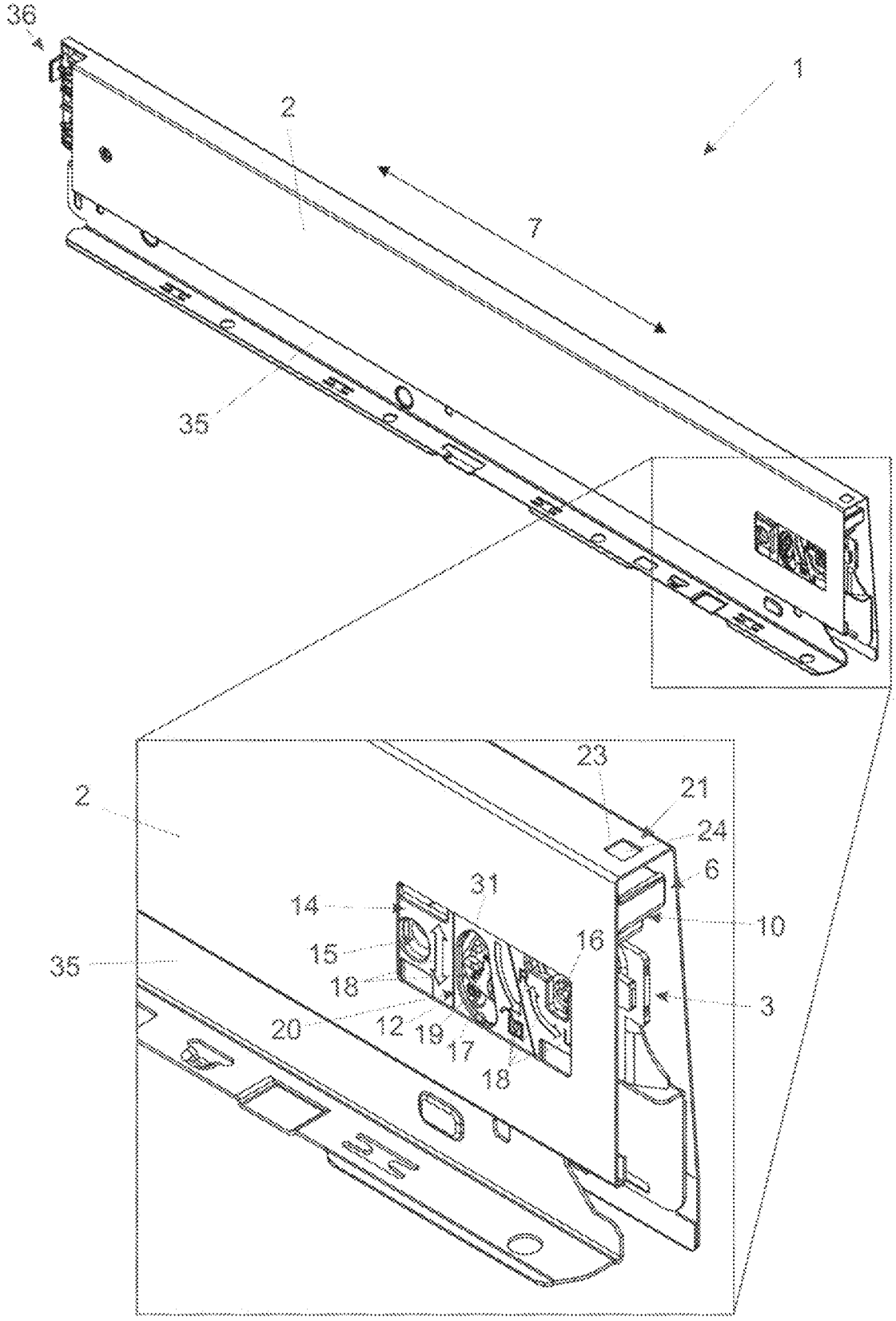
FIG. 1 is a perspective view of a drawer side wall.

FIG. 1 shows a drawer side wall 1 including a cover profile 2 and a fixing device 3 for releasably fixing a front panel to the drawer side wall 1, the fixing device 3 being arranged in the interior of the cover profile 2. In the illustrated embodiment the cover profile 2 as viewed in cross-section is substantially U-shaped.

The fixing device 3 is arranged in a front region of the drawer side wall 1, that faces towards the front panel. In addition, the drawer side wall 11 also includes a rearward end having a rear wall holder 36, to which a rear wall can be fixed. The longitudinal extent of the drawer side wall 1 is denoted by reference 7.

As can be seen from the enlarged view of the portion of the front end of the drawer side wall 1 the drawer side wall 1 also includes a multi-function component 6 provided separately from the cover profile 2 and the fixing device 3. The multi-function component 6 can be seen on the one hand from the front which is towards the front panel and on the other hand through an opening 12 in a side wall of the cover profile 2. The details of the multi-function component 6 are described more specifically by means of the following Figures.

The drawer side wall 1 further includes a carrier profile 35, at which the cover profile 2, the fixing device 3 and the multi-function component 6 are disposed.

Figure 2A:
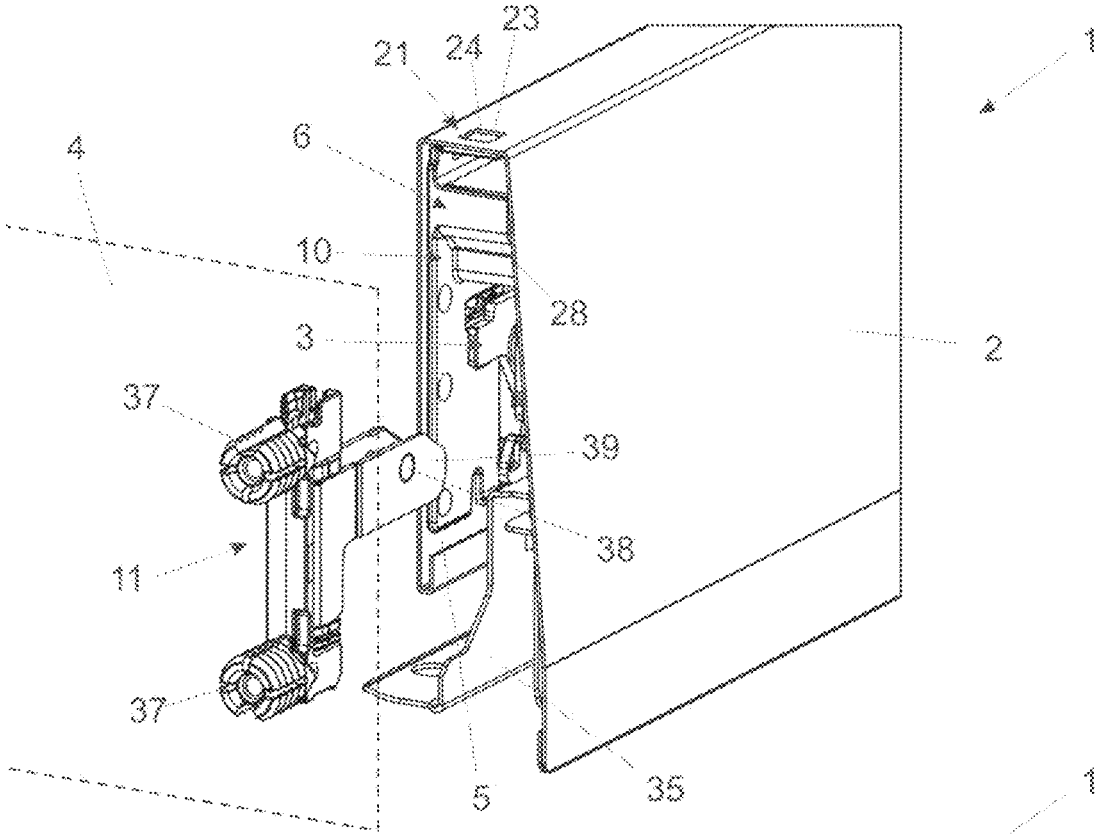
FIGS. 2*a*, 2*b* are perspective views of the front part of a drawer side wall and a furniture fitment arranged at a spacing therefrom (FIG. 2*a*) and locked to the fixing device respectively.
Figure 2B:
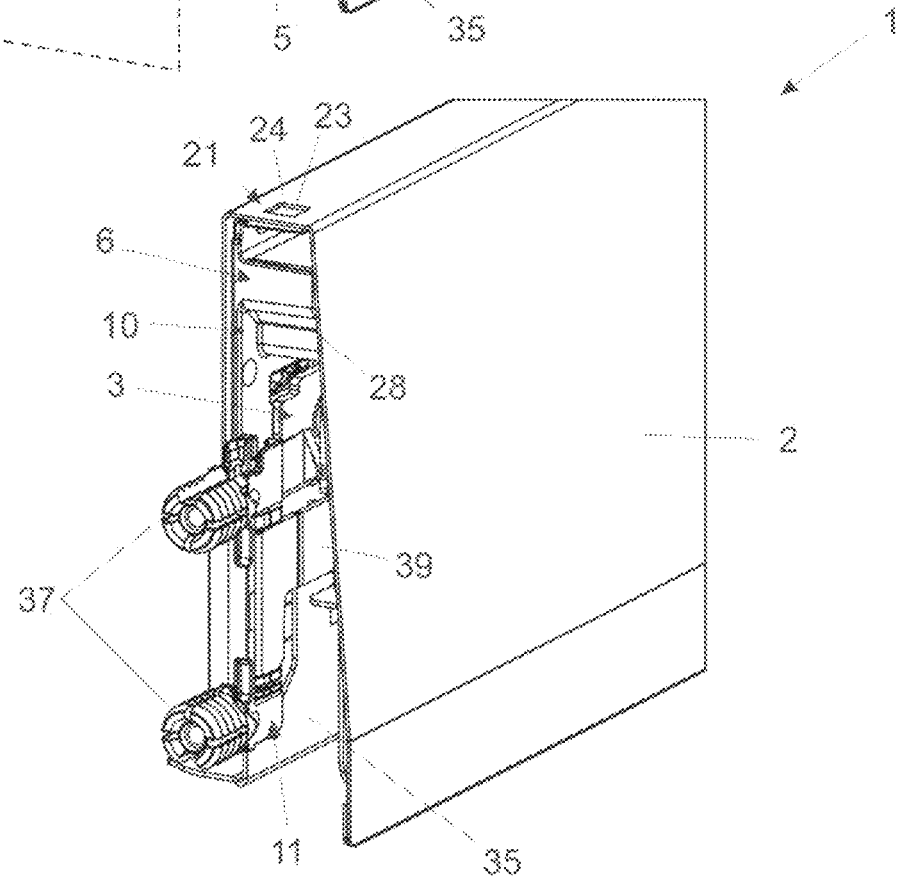
Figure 3A:
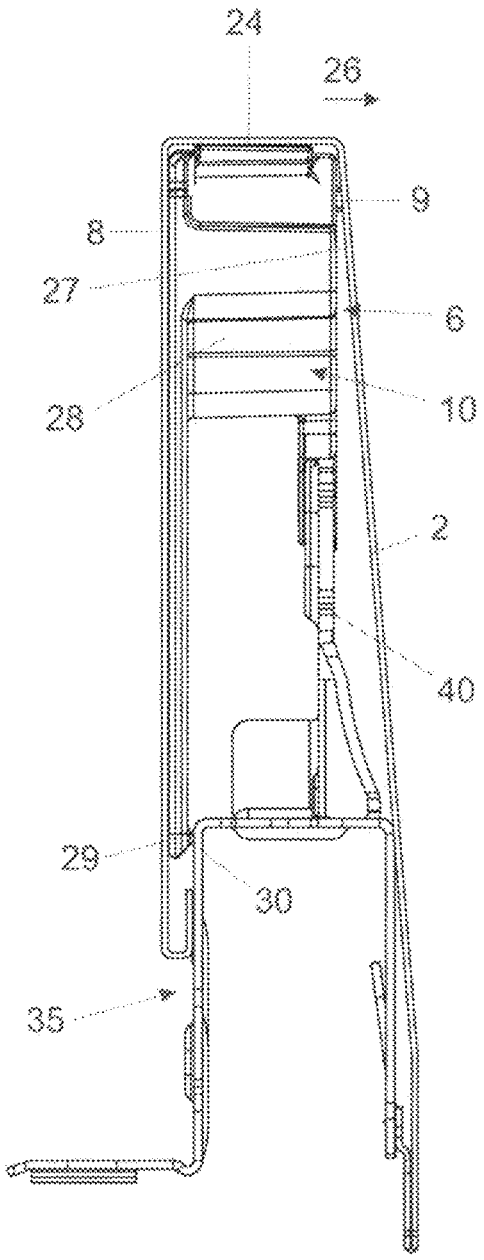
FIG. 3*a* is a plan view of a drawer side wall from the direction of the front panel, parts of the fixing device being omitted.
Figure 3B:
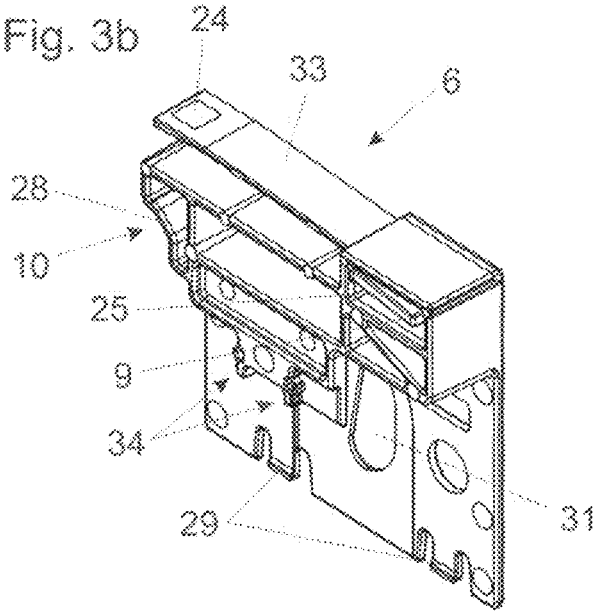
FIGS. 3*b*-3*d* are two different perspective views (FIGS. 3*b* and 3*c*) and a plan view from above (FIG. 3*d*) of the multi-function component.
Figure 3C:
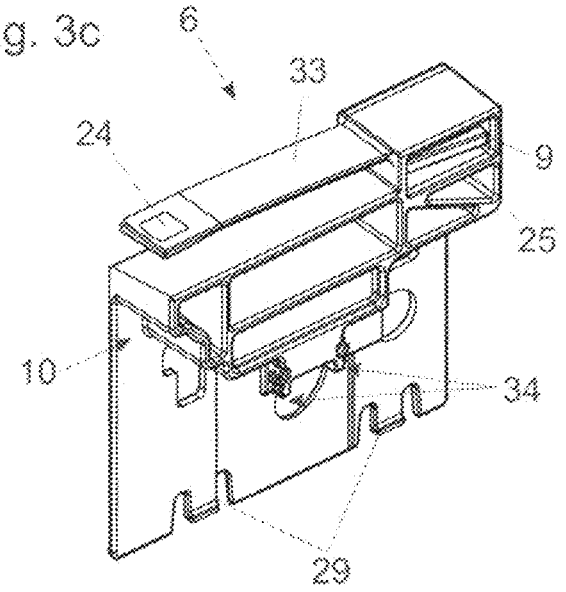
Figure 3D:
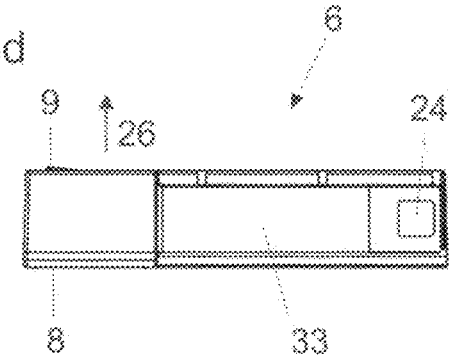

As can be seen from FIGS. 2*a* and 2*b*, the fixing device 3 serves for releasably fixing a front panel 4 (indicated in broken line in FIG. 2*a*) to the drawer side wall 1. For that purpose, a furniture fitment 11 is mounted to the front panel 4, for example by way of a dowel 37. The furniture fitment 11 can include a U-shaped profile 39, in which a pin 38 is arranged. The furniture fitment 11 can be arranged in a release position (see FIG. 2*a*) or in a locked position (see FIG. 2*b*).

FIGS. 3*a* to 3*d* serve inter alia to illustrate the property that the multi-function component 6 has at least two support contours 8, 9 which are spaced from each other transversely relative to a longitudinal extent 7 of the drawer side wall 11 and at which the cover profile 2 is supported.

One of the two support contours, denoted by reference number 8, has a flat configuration and bears against an inner wall 5 (see for example FIG. 2*a*) of the cover profile 2. The other support contour 9 is arranged at the free end of a spring element 25 and is supported at an oppositely disposed inner wall 27 (see for example FIG. 4*a*) of the cover profile 2. The position of the cover profile 2 in relation to the multi-function component 6 is therefore precisely defined.

At the same time, the multi-function component 6 is connected on the one hand to a mounting plate 40 of the fixing device 3 (see the description of FIGS. 9*a* and 9*b*), with the fixing device 3 in turn being fixedly connected to the carrier profile 35. On the other hand, the multi-function component 6 is supported by two spring elements 29 at a stationary part 30 of the drawer side wall 1 and in the specifically illustrated embodiment the carrier profile 35 respectively. In that way, the position of the multi-function component 6 is established relative to the fixing device 3 and the carrier profile 35 respectively. Viewed overall therefore the position of the cover profile 2 is also established relative to the carrier profile 35, whereby it is possible to achieve stabilization of the entire drawer side wall.

It should be noted that the spring element 25, at which the support contour 9 is arranged, acts with a force on the support contour 9 in the direction 25 of the inner wall 27 of the cover profile 2.

Figure 4A:
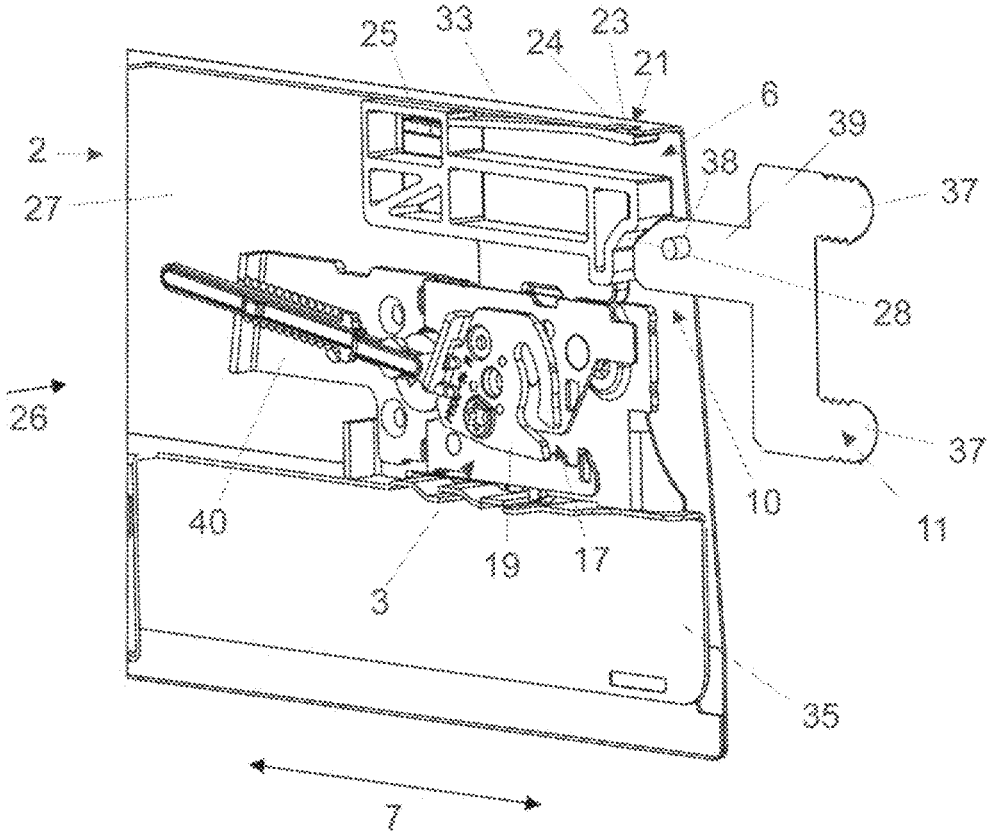
FIGS. 4*a*, 4*b* is a perspective cross-sectional view of the front part of a drawer side wall and a furniture fitment, wherein the furniture fitment is in an incorrect position (FIG. 4*a*) and in a target position (FIG. 4*b*) with the furniture fitment being only diagrammatically indicated.
Figure 4B:
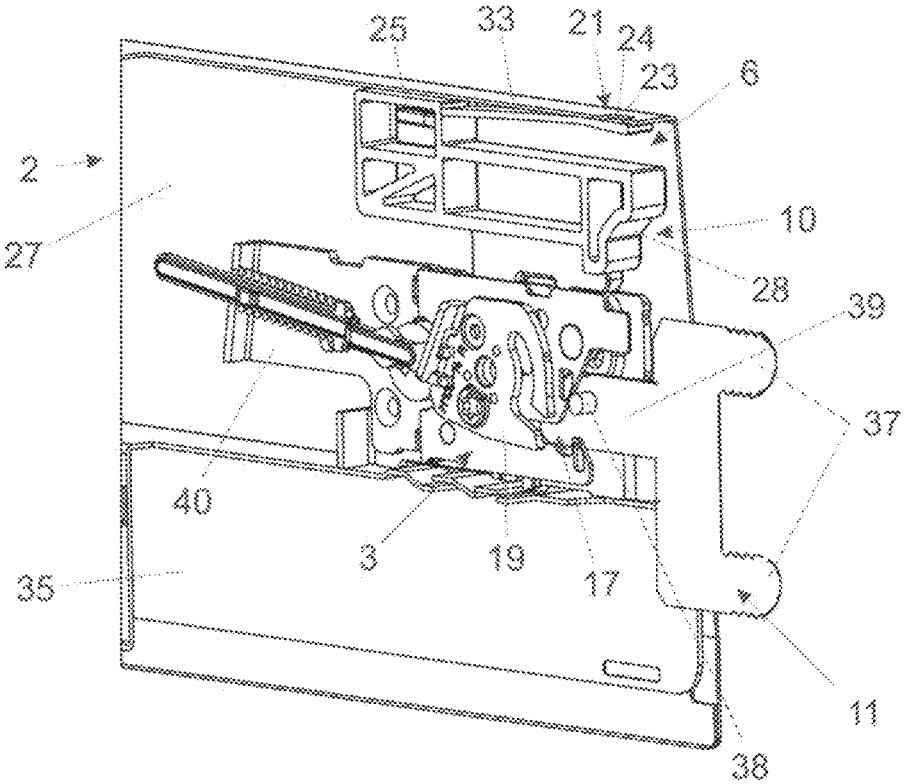

FIGS. 4*a* and 4*b* serve inter alia to illustrate the property that the multi-function component 6 has a joining device 10 facing in the direction of the front panel 4 to be fixed, to facilitate insertion of a furniture fitment 11 to be mounted to the front panel 4 into the fixing device 3.

The fixing device 3 includes, inter alia, a movable component 19 in the form of a spring-loaded and rotatably mounted catch lever which catches the pin 38 of the furniture fitment 11 and pulls it in the direction of the rear end of the drawer side wall 1. The pin 38 and therewith the furniture fitment 11 are then locked. If there should be a wish to release the furniture fitment 11 from the fixing device 3 again, then for that purpose the catch lever 19 has to be pivoted in opposition to the catch direction of rotation by a screwdriver or the like. Overall, the fixing device 3 thus includes a device 17 for locking and releasing the front panel 4 to and from the fixing device 3.

For locking the front panel 4 or the furniture fitment 11 mounted thereto, it is necessary to move the furniture fitment 11 into a predetermined position relative to the fixing device 3. That is not always successful at the first attempt. In other words, the furniture fitment 11 assumes the wrong position relative to the fixing device 3, whereby in the state of the art that can involve clamping or hooking engagement of the furniture fitment 11 on the fixing device 3 and/or the cover profile 2. To prevent that and to move the furniture fitment 11 or the front panel 4 in the direction of the predetermined position, the multi-function component 6 includes a joining device 10 having a deflection contour 28 arranged inclinedly relative to the longitudinal extent 7 of the drawer side wall 1. That joining device 10 therefore enhances the operating comfort from the point of view of the user.

Figure 5A:
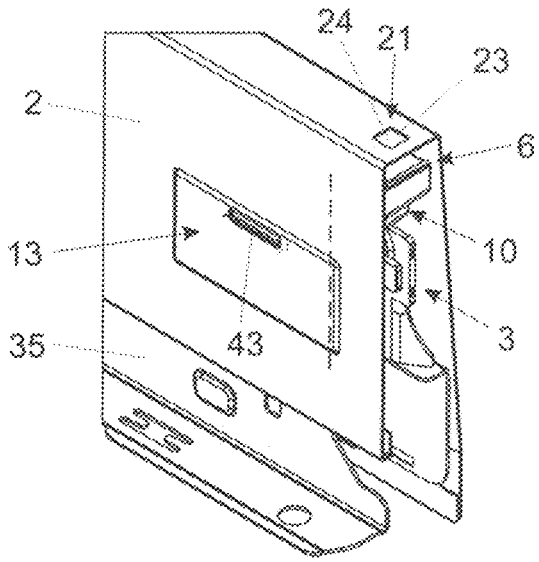
FIGS. 5*a*, 5*b* is a perspective cross-sectional view of the front part of a drawer side wall with a cover portion, on the one hand with a cover profile (FIG. 5*a*) and on the other hand without it (FIG. 5*b*)
Figure 5B:
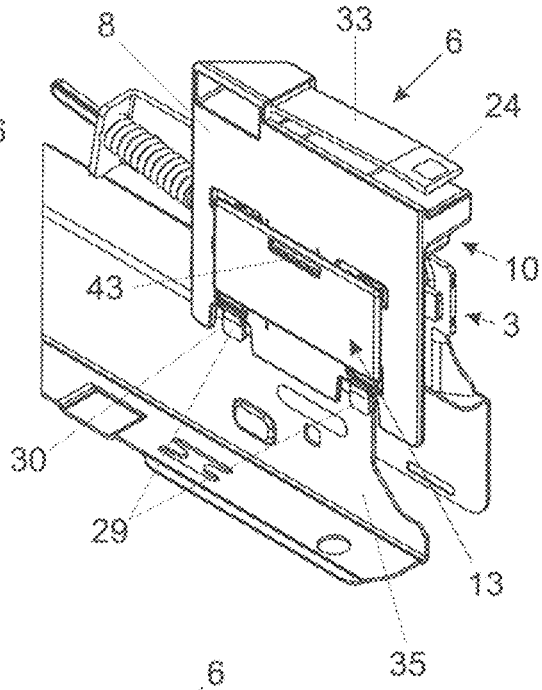
Figure 5C:
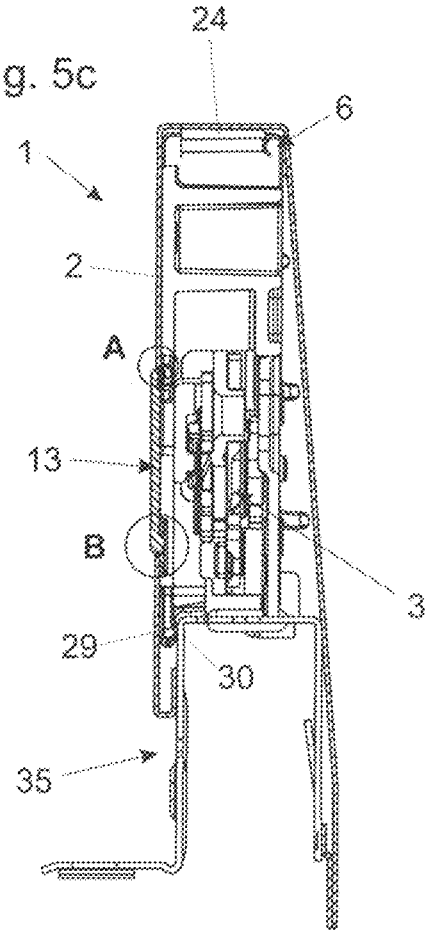
FIG. 5*c* is a cross-sectional view of the drawer side wall of FIG. 5*a* along the cross-sectional plane indicated by a broken line in FIG. 5*a*, FIGS. 6*a* and 6*b* are a perspective view (FIG. 6*a*) and a plan view from the side (FIG. 6*b*) of the multi-function component.
Figure 5C:
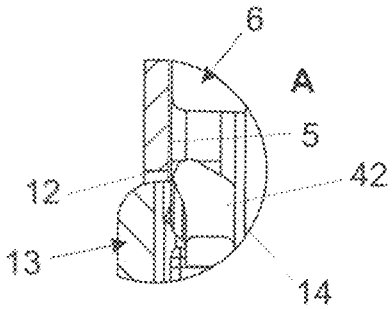
Figure 5C:
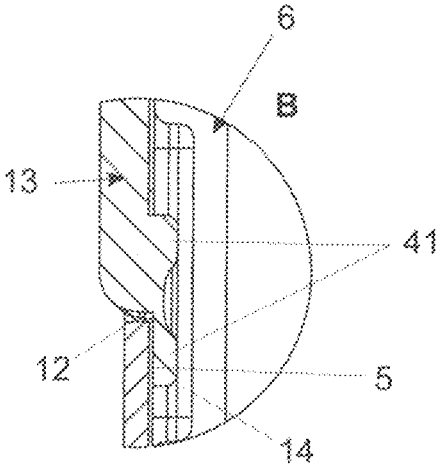

FIGS. 5*a* to 5*c* serve inter alia to illustrate the property that the cover profile 2 has an opening which can be covered by a cover portion 13, the multi-function component 6 including a support structure 14 at which the cover portion 13 can be supported when covering the opening 12.

Figure 7:
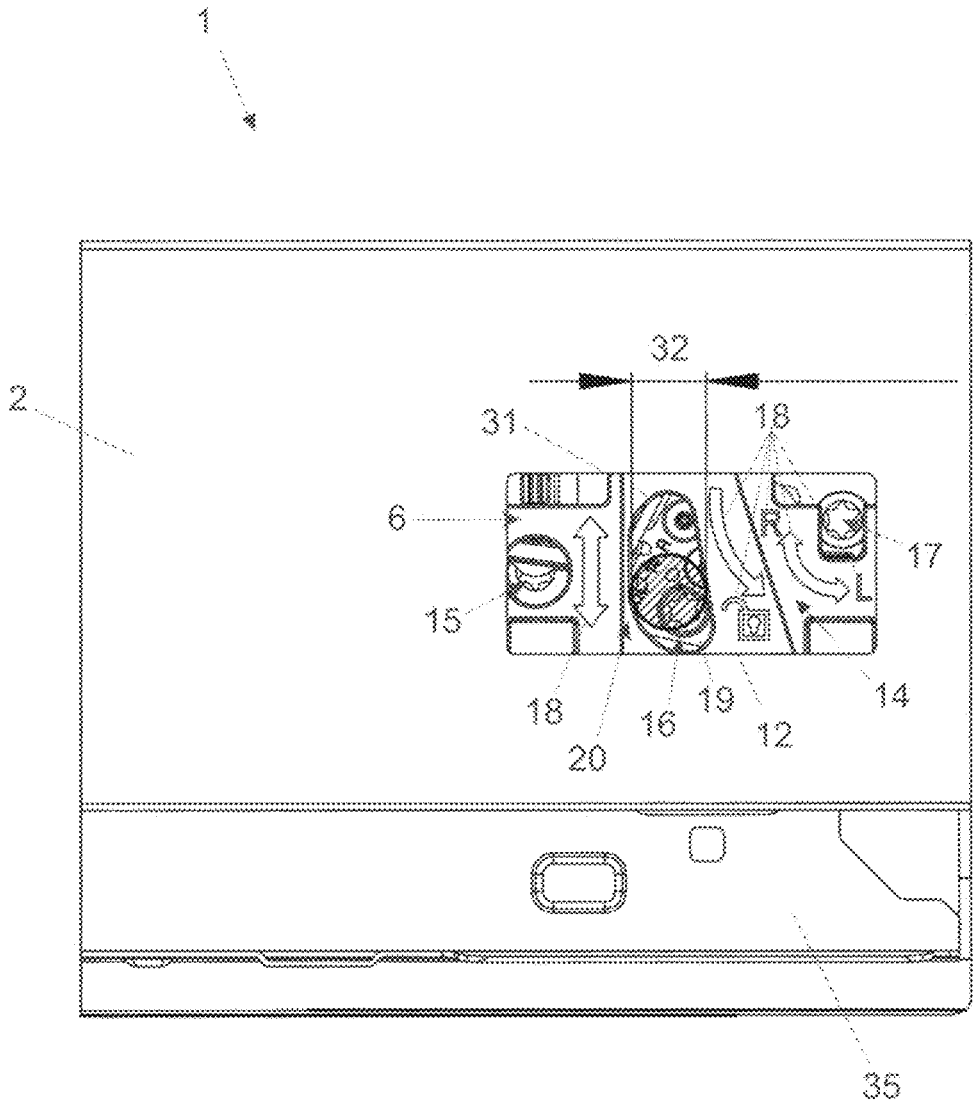
FIG. 7 is a view from the side of the front part of a drawer side wall without cover portion.

The cover portion 13 serves to cover the opening 12 in the cover profile 2, by way of which the user is permitted to have access to the device 17 for locking and releasing the front panel 4 to and from the fixing device 3 and to adjusting devices 15, 16 for adjusting the position of the front panel 4 with respect to the drawer side wall 1 (see also FIG. 7). Usually those devices 15, 16, 17 are required only rarely. Otherwise, the wish would be to cover the access for aesthetic reasons. In that respect the cover element 13 should project as little as possible beyond the side surface of the cover profile 2, in which the opening 12 is formed, in order to have as little adverse effect as possible on an arrangement of articles in the drawer.

To comply with those requirements it is appropriate for the cover portion 13 to be made very thin and to be releasably fixed to the drawer side wall 1 as follows: the cover portion 13 has on the one hand in the mounting position at the lower edge two attachment tabs 41 which on the one hand bear against an inner wall 5 of the cover profile 2 and on the other hand against the support structure 14 of the multi-function component 6 (see the enlarged portion B of FIG. 5*c*). On the other hand, the cover portion 13 in the mounting position at the upper edge has two snap catches 42 which snappingly engage behind the edge of the opening 12 at the inside 5 of the cover profile 2 (see the enlarged portion A of FIG. 5*c*).

As already stated in connection with FIGS. 3*a* to 3*d*, the multi-function component 6 is acted upon by a force in the direction of the opening 12 of the cover profile 2 by two spring elements 29 which bear against a stationary part 30 of the drawer side wall 1.

The cover portion 13 can be removed from the opening 12 again by way of a slot 43 into which a tool or the fingernail of a user can be inserted.

Figure 6A:
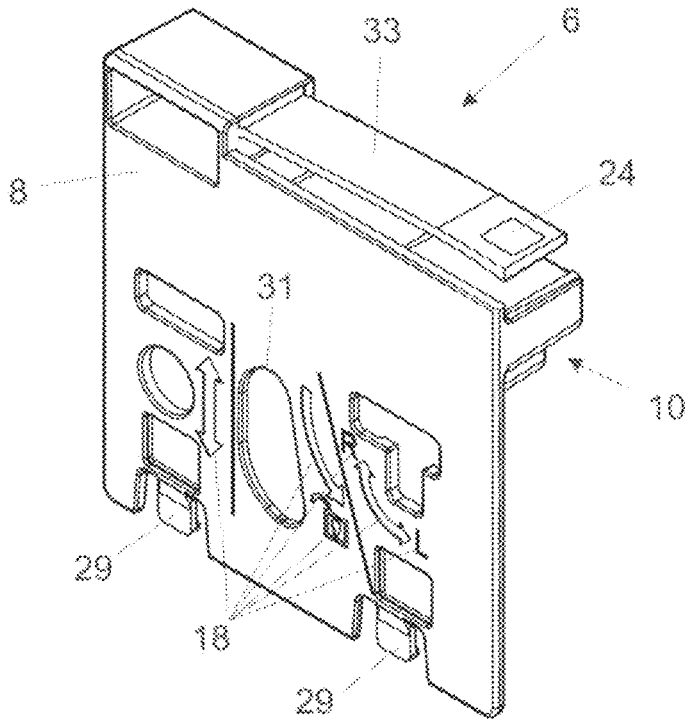
Figure 6B:
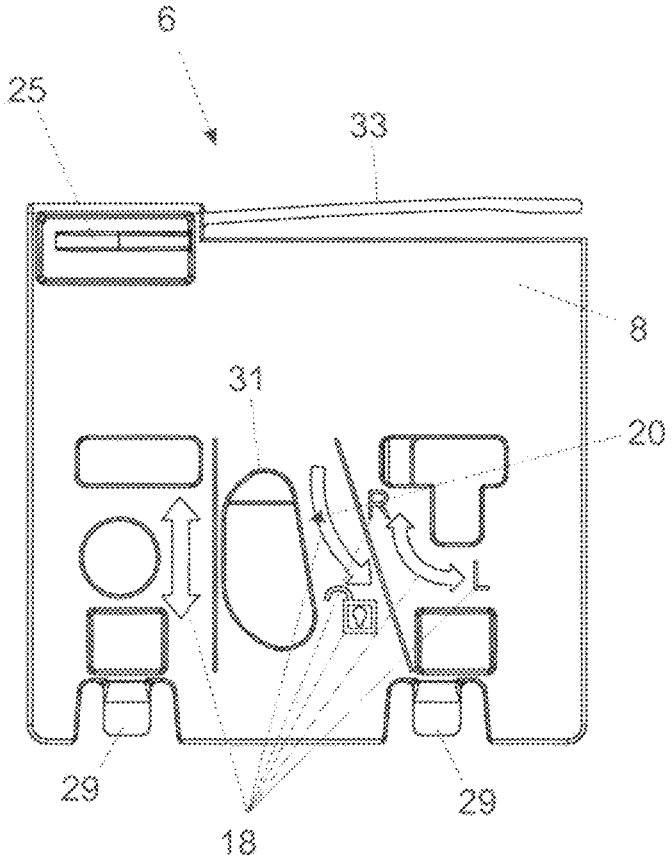

FIGS. 6*a* and 6*b* serve, inter alia, to illustrate the property that the fixing device 3 has at least one adjustment device 15, 16 for adjusting the position of the front panel 4 with respect to the drawer side wall 1 and/or a device 17 for locking and/or releasing the front panel 4 to or from the fixing device 3. The multi-function component 6 includes operating instructions composed of lines 18 for facilitating operation of the at least one adjustment device 15, 16 or device 17 for locking and/or releasing the front panel 4 by a user.

Besides the device 17 already mentioned hereinbefore for locking and releasing the front panel 4 to or from the fixing device 3, the fixing device 3 also includes two adjustment devices 15 and 16 for adjustment of the position of the front panel 4 with respect to the drawer side wall 1 (see also FIG. 7). In that respect, the adjustment device 15 serves for adjustment of the relative position of the front panel 4 with respect to the drawer side wall 1 in a vertical direction, and the adjustment device 16 serves for adjustment of the relative position of the front panel 4 with respect to the drawer side wall 1 in the horizontal direction. To make it easier for a user to operate the devices 15, 16, 17, the multi-function component 6 includes operating instructions composed of lines 18. They can be embossed or engraved into the multi-function component 6.

FIG. 7 serves, inter alia, to illustrate that the fixing device 3 has at least one component 19 movable relative to the drawer side wall 1, wherein the multi-function component 6 includes a cover 20 for at least region-wise shielding of the movable component 19 upon a movement relative to the drawer side wall 1.

As already stated in relation to FIGS. 4*a* and 4*b*, the fixing device 3 includes a movable part 19 in the form of a spring-loaded catch lever. As that part 19 moves relative to the stationary drawer side wall 1 in the state of the art, a user can suffer injury, for example at the fingers. To prevent that, the multi-function component 6 has a cover (shield) 20 for the movable component 9 in the movement relative to the drawer side wall 1.

At the same time, however, there would also be the wish to have the option of actuating the movable part 19 from the exterior. In many cases, therefore, an actuating opening 31 is needed. As a compromise between those demands, the cover means 20 has at least one actuating opening 31 of a maximum width 32 of 10 mm, preferably 8 mm, for actuation of the movable component 19.

FIGS. 8*a* to 8*d* serve, inter alia, to illustrate the property that the cover profile 2 has at least one interface 21 for connecting an attachment element 22. The interface 21 includes an opening 23 in the cover profile 2 and the multi-function component 6 includes a movably mounted cover portion 24 which closes the opening 23 in a first position and exposes the opening 23 in a second position.

Figure 8A:
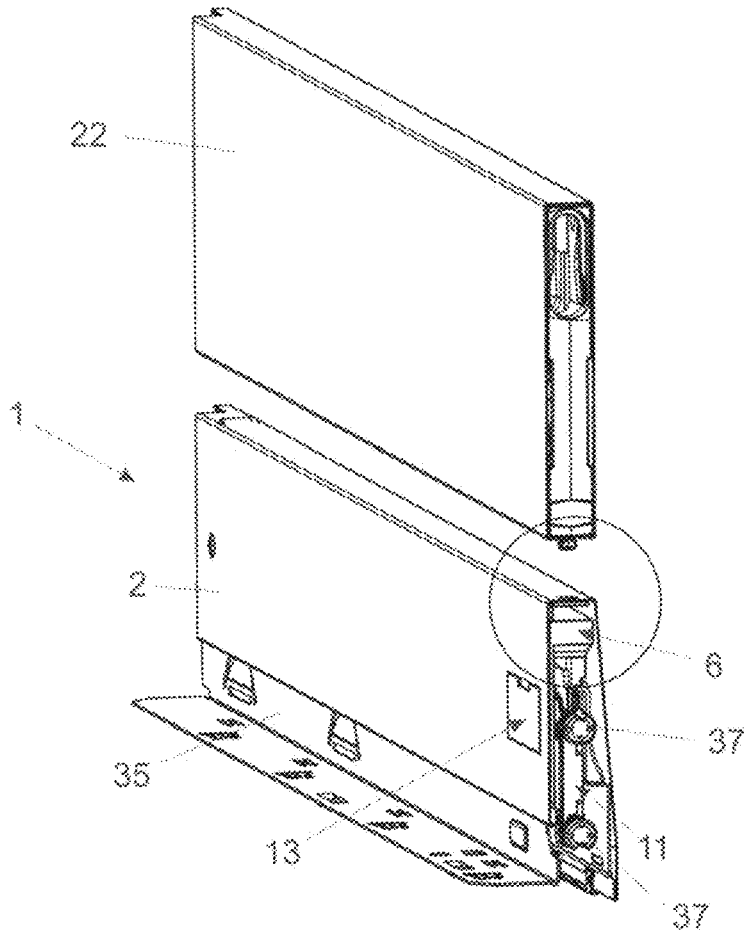
FIG. 8*a* is a perspective view of an arrangement comprising a drawer side wall and an attachment element.

FIG. 8*a* shows a perspective view from the front of the drawer side wall 1 with an attachment element 22. In the illustrated embodiment, the opening 22 is arranged at a front end of the drawer side wall 1 or the cover profile 2 respectively. The attachment element 22 includes a pin 44 which can be introduced into the opening 23. The cover portion 24 is movable into an open position of exposing the opening 23 by introduction of the pin 44 into the opening 23, starting from a closed position of covering the opening 23, in opposite relationship to the spring action of the spring element 33. For that situation where the attachment element 22 has a solid decorative panel (for example of glass), then the pin 44 would have to be arranged on an adaptor portion which can be connected to the decorative panel.

Figure 8B:
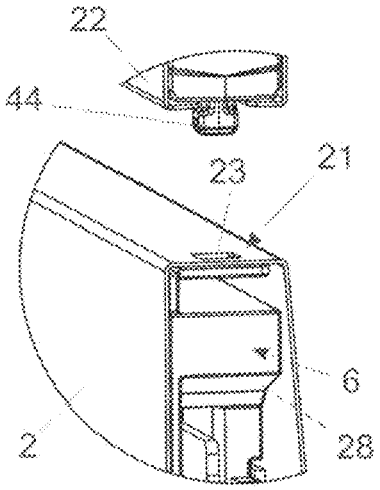
FIGS. 8*b*-8*d* show different positions of the attachment element and the drawer side wall relative to each other in a portion marked by a circle in FIG. 8*a*, and FIGS. 9*a*, 9*b* are views from the side of an arrangement comprising a mounting plate of the fixing device and the multi-function component, on the one hand at a spacing (FIG. 9*a*) and on the other hand in a fixed position (FIG. 9*b*).
Figure 8C:
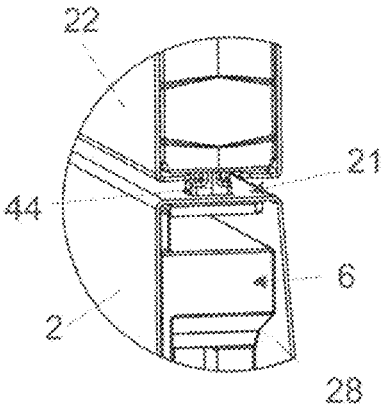
Figure 8D:
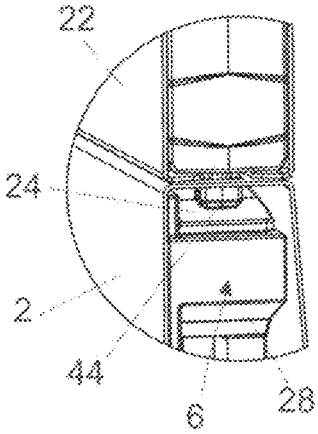

FIG. 8*b* shows an enlarged view of the region circled in FIG. 8*a*, showing the pin 44 of the attachment element 22, that is to be introduced into the opening 23. In this arrangement, the cover portion 24 is in a closed position of covering the opening 23. In FIG. 8*c*, the pin 44 is in contact with the cover portion 24, and by a continued movement of the pin 44 downwardly, the pin 44 urges the cover portion 24 in opposition to the resilient effect of the spring element 23 into an open position of exposing the opening 23, as shown in FIG. 8*d*. The pin 44 of the attachment element 22 in the mounted position therefore engages into the opening 23 so that lateral and/or vertical displacement of the attachment element 22 relative to the drawer side wall is prevented or limited. The attachment element 22 can also include an actuating device (not shown) for the pin 44, by which the pin 44 can be fixed in force-locking or positively locking relationship with the drawer side wall 1. If the pin 44 is removed from the opening 23 again then the cover portion 24 automatically snaps back by the force of the spring element 33 into the closed position in which the opening 23 is closed by the cover portion 24. In that way, this gives on the one hand an attractive visual appearance while on the other hand it is also possible to prevent the ingress of dirt into the interior of the drawer side wall 1.

Figure 9A:
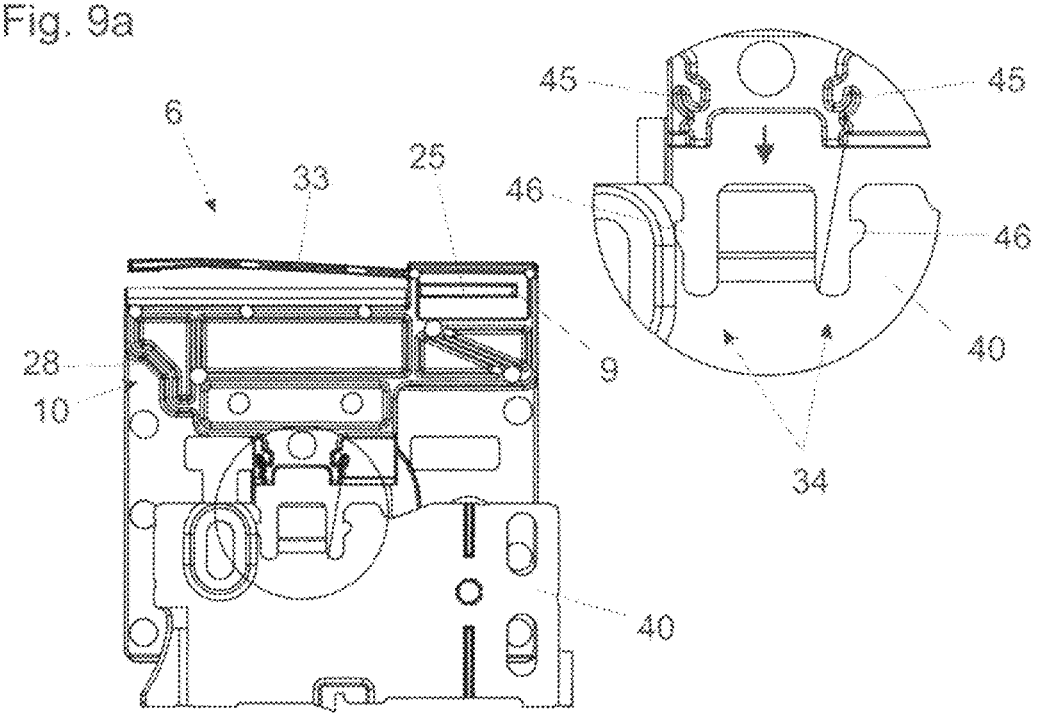
Figure 9B:
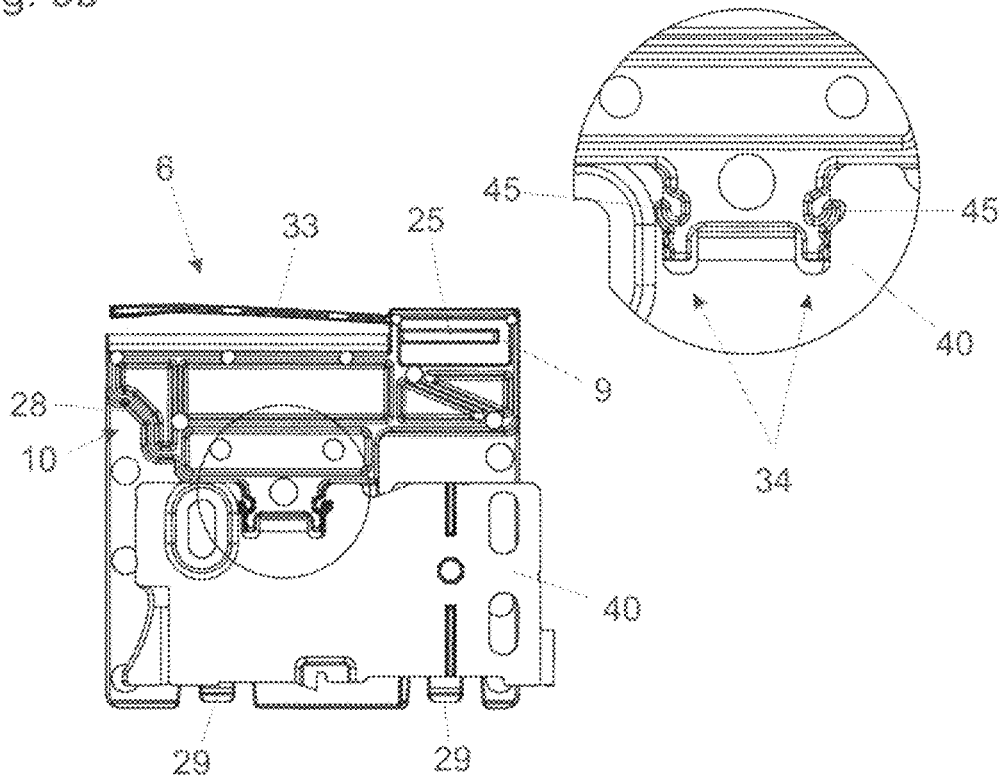

Finally, FIGS. 9*a* and 9*b* show the connection of the multi-function component 6 to the mounting plate 40 of the fixing device 3. More specifically, the connection is effected by a snap-engagement and latching connection 34 implemented by two hooks 45 which are provided on the multi-function component 6 and which snappingly engage or latch into corresponding openings 46 on the mounting plate 40. Equally well, however, the hooks 45 can naturally also be arranged on the mounting plate 40 with the corresponding openings 46 on the multi-function component 6.

The invention claimed is:

1. A drawer side wall comprising:

a cover profile; and a fixing device for releasably fixing a front panel to the drawer side wall, wherein the fixing device is at least predominantly arranged in an interior of the cover profile, wherein the cover profile has an inner wall and the drawer side wall has a multi-function component separate from the cover profile and from the fixing device, and the multi-function component is at least region-wise arranged between the inner wall of the cover profile and the fixing device, wherein the fixing device is a self-contained functional unit so that a furniture fitment to be mounted to the front panel can be releasably fixed independently of the multi-function component by the fixing device, wherein the cover profile has an opening to be covered by a cover portion, the multi-function component includes a support structure at which the cover portion can be supported when covering the opening, and wherein the cover profile has an interface for connecting an attachment element, and the interface includes an opening in the cover profile and the multi-function component includes a movably mounted cover portion to close the opening in a first position and expose the opening in a second position.

2. The drawer side wall according to claim 1, wherein the multi-function component has at least two support contours spaced from each other transversely relative to a longitudinal extent of the drawer side wall and at which the cover profile is supported, and the drawer side wall further comprises a spring element at which one of the two support contours is arranged, and the spring element being configured to act with a force on the one of the two support contours in the direction of an inner wall of the cover profile.

3. The drawer side wall according to claim 1, wherein the multi-function component has a joining device facing in a direction of the front panel to facilitate insertion of the furniture fitment into the fixing device, and wherein the joining device includes a deflection contour arranged inclinedly relative to a longitudinal extent of the drawer side wall.

4. The drawer side wall according to claim 1, wherein the cover profile has an opening to be covered by a cover portion, and the multi-function component includes a support structure at which the cover portion can be supported when covering the opening, and the multi-function component has a spring element to support the multi-function component at a stationary part of the drawer side wall and to act upon the multi-function component with a force in a direction of the opening of the cover profile.

5. The drawer side wall according to claim 1, wherein the fixing device has an adjustment device for adjusting a position of the front panel with respect to the drawer side wall and/or a device for locking and/or releasing the front panel to or from the fixing device, and the multi-function component includes operating instructions consisting of lines for facilitating operation of the adjustment device or device for locking and/or releasing the front panel by a user, and wherein the lines are engraved or embossed into the multi-function component.

6. The drawer side wall according to claim 1, wherein the multi-function component encloses at least a portion of the fixing device.

7. The drawer side wall according to claim 1, wherein the multi-function component is connected to the fixing device by snap-engagement and/or latching connection.

8. The drawer side wall according to claim 1, wherein the drawer side wall has a carrier profile at which the cover profile, the fixing device and/or the multi-function component are arranged.

9. The drawer side wall according to claim 1, wherein the multi-function component comprises plastic.

10. A drawer comprising the drawer side wall according to claim 1.

11. A drawer side wall comprising:

a cover profile; and a fixing device for releasably fixing a front panel to the drawer side wall, wherein the fixing device is at least predominantly arranged in an interior of the cover profile, wherein the cover profile has an inner wall and the drawer side wall has a multi-function component separate from the cover profile and from the fixing device, and the multi-function component is at least region-wise arranged between the inner wall of the cover profile and the fixing device, wherein the fixing device is a self-contained functional unit so that a furniture fitment to be mounted to the front panel can be releasably fixed independently of the multi-function component by the fixing device, and wherein at least one property selected from the following group of properties (i)-(v) is implemented:

(i) the multi-function component has at least two support contours spaced from each other transversely relative to a longitudinal extent of the drawer side wall and at which the cover profile is supported, (ii) the multi-function component has a joining device facing in a direction of the front panel to facilitate insertion of the furniture fitment into the fixing device, (iii) the cover profile has an opening to be covered by a cover portion, and the multi-function component includes a support structure at which the cover portion can be supported when covering the opening, (iv) the fixing device has an adjustment device for adjusting a position of the front panel with respect to the drawer side wall and/or a device for locking and/or releasing the front panel to or from the fixing device, and the multi-function component includes operating instructions consisting of lines for facilitating operation of the adjustment device or device for locking and/or releasing the front panel by a user, (v) the cover profile has an interface for connecting an attachment element, and the interface includes an opening in the cover profile and the multi-function component includes a movably mounted cover portion to close the opening in a first position and expose the opening in a second position, and wherein the fixing device has a movable component movable relative to the drawer side wall, and the multi-function component includes a cover for shielding at least a portion of the movable component upon a movement relative to the drawer side wall, and wherein the cover has an actuating opening with a maximum width of 10 mm for actuation of the movable component.

12. A drawer side wall comprising:

a cover profile; and a fixing device for releasably fixing a front panel to the drawer side wall, wherein the fixing device is at least predominantly arranged in an interior of the cover profile, wherein the cover profile has an inner wall and the drawer side wall has a multi-function component separate from the cover profile and from the fixing device, and the multi-function component is at least region-wise arranged between the inner wall of the cover profile and the fixing device, wherein the fixing device is a self-contained functional unit so that a furniture fitment to be mounted to the front panel can be releasably fixed independently of the multi-function component by the fixing device, and wherein at least one property selected from the following group of properties (i)-(v) is implemented:

(i) the multi-function component has at least two support contours spaced from each other transversely relative to a longitudinal extent of the drawer side wall and at which the cover profile is supported, (ii) the multi-function component has a joining device facing in a direction of the front panel to facilitate insertion of the furniture fitment into the fixing device, (iii) the cover profile has an opening to be covered by a cover portion, and the multi-function component includes a support structure at which the cover portion can be supported when covering the opening, (iv) the fixing device has an adjustment device for adjusting a position of the front panel with respect to the drawer side wall and/or a device for locking and/or releasing the front panel to or from the fixing device, and the multi-function component includes operating instructions consisting of lines for facilitating operation of the adjustment device or device for locking and/or releasing the front panel by a user, and (v) the fixing device has a movable component movable relative to the drawer side wall, and the multi-function component includes a cover for shielding at least a portion of the movable component upon a movement relative to the drawer side wall, wherein the cover profile has an interface for connecting an attachment element, and the interface includes an opening in the cover profile and the multi-function component includes a movably mounted cover portion to close the opening in a first position and expose the opening in a second position, and wherein the drawer side wall further comprises a spring element by which the cover portion is prestressed in an operative direction of the spring element in the direction of the first position.

* * * * *